US007137211B2

(12) United States Patent
Johnson et al.

(10) Patent No.: US 7,137,211 B2
(45) Date of Patent: Nov. 21, 2006

(54) DRYING CABINET SHAKER MECHANISM

(75) Inventors: Troy A. Johnson, Newton, IA (US); Dean L. Schaffran, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/920,751

(22) Filed: Aug. 18, 2004

(65) Prior Publication Data

US 2006/0037209 A1 Feb. 23, 2006

(51) Int. Cl.
*F26B 5/14* (2006.01)

(52) U.S. Cl. ..... 34/381; 34/401; 34/164

(58) Field of Classification Search ..... 34/90, 34/164, 179, 184, 240, 381, 401, 380
See application file for complete search history.

(56) References Cited

U.S. PATENT DOCUMENTS

| | | | | |
|---|---|---|---|---|
| 1,542,817 | A * | 6/1925 | Bernheim | 312/134 |
| 3,114,919 | A | 12/1963 | Kenreich | |
| 3,252,311 | A * | 5/1966 | Boyer | 68/253 R |
| 3,392,891 | A * | 7/1968 | Gingher | 223/85 |
| 3,739,496 | A | 6/1973 | Buckley et al. | |
| 3,861,179 | A | 1/1975 | Orchard | |
| 4,211,121 | A * | 7/1980 | Brown | 74/87 |
| 5,558,437 | A * | 9/1996 | Rode | 366/208 |
| 6,045,588 | A * | 4/2000 | Estes et al. | 8/142 |
| 6,591,638 | B1 | 7/2003 | Estes et al. | |
| 2003/0223309 | A1 | 12/2003 | Hapke | |

FOREIGN PATENT DOCUMENTS

| | | | |
|---|---|---|---|
| DE | 4024901 | A1 | 2/1992 |
| JP | 404084998 | A | 3/1992 |
| JP | 406339598 | A | 12/1994 |
| JP | 2002000997 | A | 1/2002 |

* cited by examiner

*Primary Examiner*—S. Gravini
(74) *Attorney, Agent, or Firm*—McKee, Voorhees & Sease, P.L.C.

(57) ABSTRACT

A clothes drying cabinet is provided with a shaker assembly including a bar suspended in the cabinet for supporting clothes hangers. A motor is mounted adjacent the bar and has a drive shaft. A drive weight is eccentrically mounted to the drive shaft of the motor so that upon actuation of the motor, the drive weight imparts a shaking motion to the bar so as to facilitate removal of wrinkles from the clothing on the hangers. A ballast weight may also be provided in the shaker assembly so as to evenly distribute the energy from the eccentric weight regardless of the weight of the clothes hanging on the bar.

21 Claims, 5 Drawing Sheets

DRYING CABINET SHAKER MECHANISM

BACKGROUND OF THE INVENTION

Clothes drying cabinets generally include a chamber or enclosure with a bar for supporting hangers with clothes. Some cabinets provide mechanisms for shaking the bar so as to facilitate wrinkle removal from the clothes while drying in the cabinet. For example, published U.S. Patent Application No. 2003/0223309 discloses a clothes hanger bar supported within a drying cabinet at four points, with a rotating disk to impart oscillating motion to the hanger bar via elastic cords extending between the disk and opposite side walls of the cabinet. Such a shaker mechanism is more costly than desirable, due in part to multiple components.

Therefore, a primary objective of the present invention is the provision of an improved shaker assembly for a clothes drying cabinet.

Another objective of the present invention is the provision of a shaker mechanism for a clothes drying cabinet which efficiently, effectively, and economically provides shaking motion to the hanger bar to facilitate wrinkle removal from the clothes.

A further objective of the present invention is the provision of a clothes drying cabinet having a bar for supporting clothes on hangers and a shaker mechanism which shakes the clothes at an optimal frequency to remove wrinkles.

Still another objective of the present invention is the provision of a clothes drying cabinet having an improved shaker assembly utilizing an eccentrically mounted weight to impart oscillating motion to the hanger bar.

Another objective of the present invention is the provision of a clothes drying cabinet having a hanging bar for clothes, with a shaker assembly that equalizes distribution of energy during the shaking action.

A further objective of the present invention is an improved method of shaking clothes in a drying cabinet to facilitate wrinkle removal.

These and other objectives will become apparent from the following description of the invention.

SUMMARY OF THE INVENTION

The clothes drying cabinet of the present invention includes a drying chamber with a bar suspended in the chamber for receiving hangers with clothes. A motor is mounted in the chamber and connected to the bar. A drive weight is eccentrically mounted on the drive shaft of the motor so as to shake the bar when the motor is actuated. The shaker assembly includes a ballast weight to equalize distribution of energy from the eccentric drive weight to the bar with varying loads on the bar. The eccentrically mounted drive weight imparts oscillating motion to the bar when the motor is actuated so as to facilitate wrinkle removal from the clothes.

DETAILED DESCRIPTION OF THE PREFERRED EMBODIMENT

Figure 1:
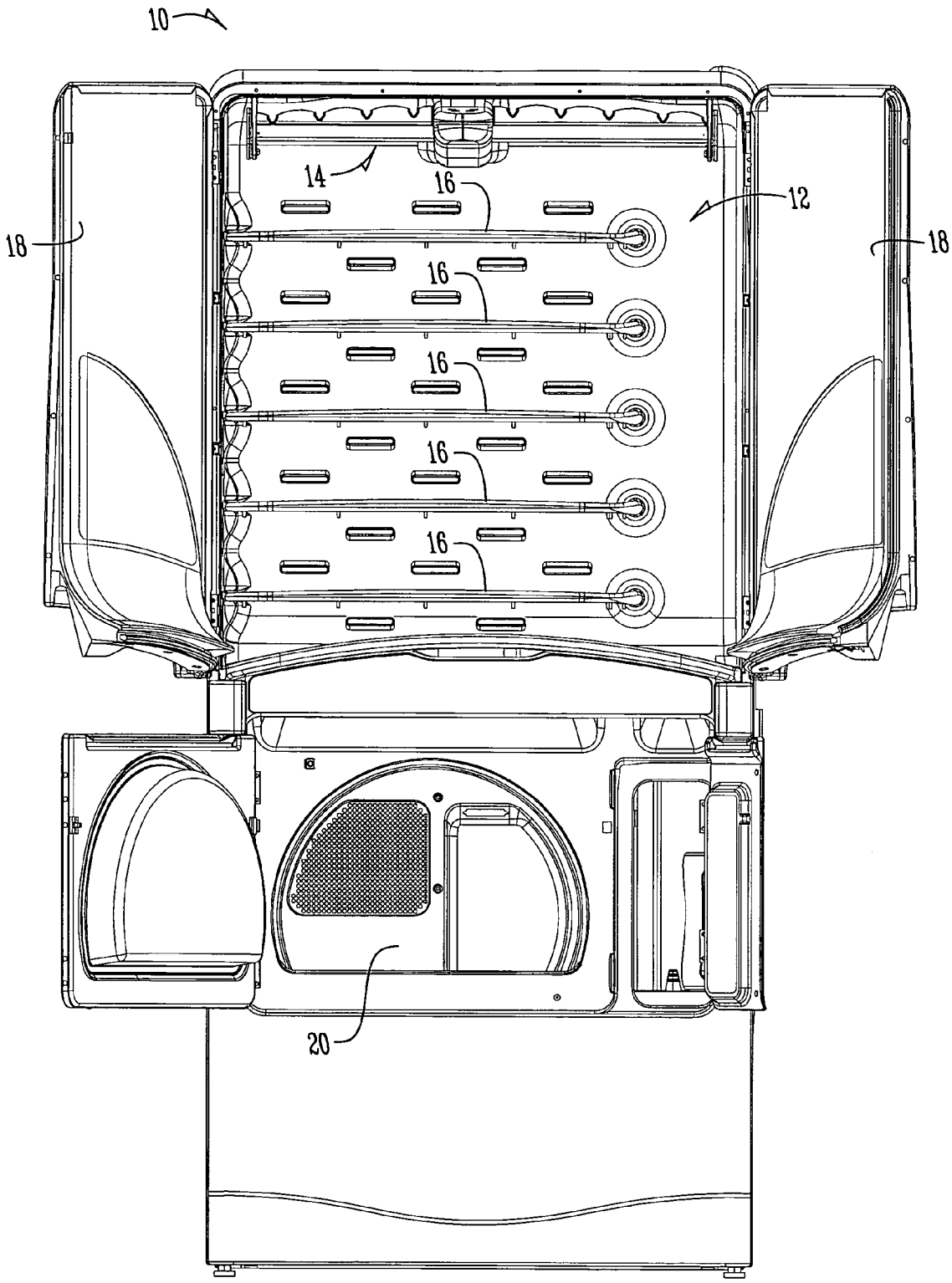
FIG. 1 is a front elevation view of a drying cabinet having the shaker assembly of the present invention.

A cabinet dryer is generally designated by the reference numeral 10 in the drawings. The cabinet dryer 10 includes a drying chamber 12 with the shaker assembly 14 of the present invention. The chamber also includes removable shelves 16 which may be utilized when the shaker assembly is not needed. The cabinet dryer 10 includes a pair of doors 18 moveable between open and closed positions relative to the drying chamber 12. FIG. 1 shows the cabinet dryer 10 in combination with a tumble dryer 20, though it is understood that the tumble dryer is not a part of the present invention.

Figure 2:
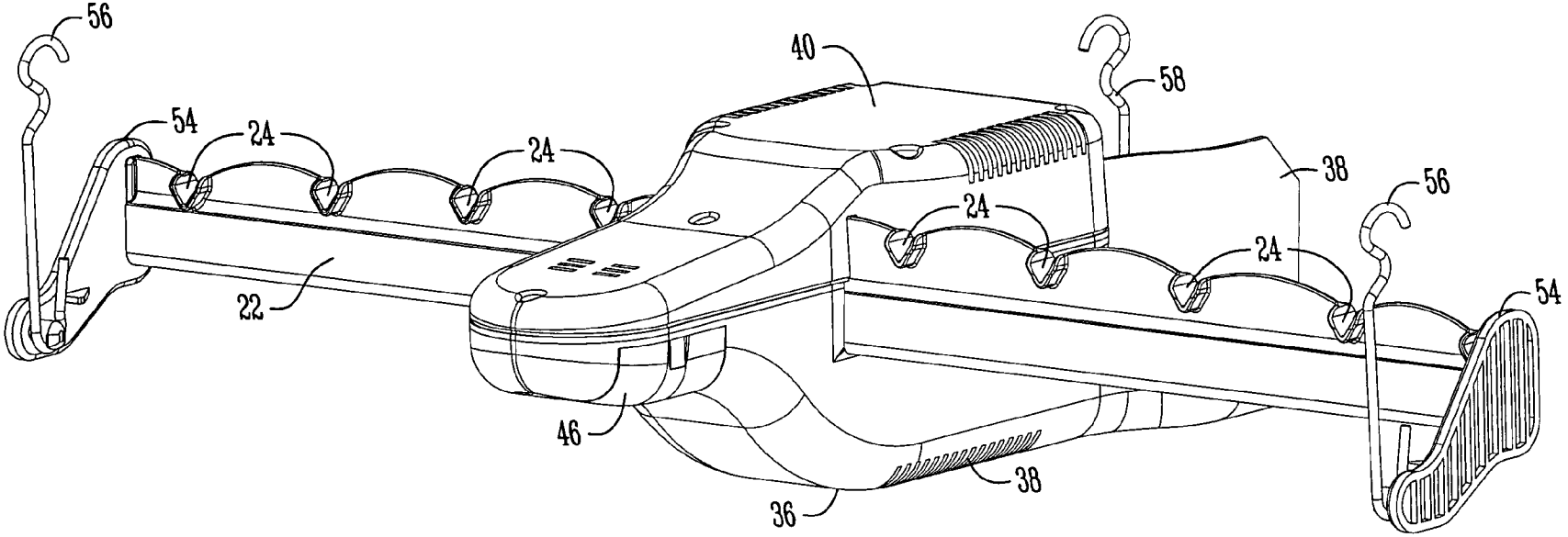
FIG. 2 is a perspective view of the shaker assembly, removed from the drying cabinet.
Figure 3:
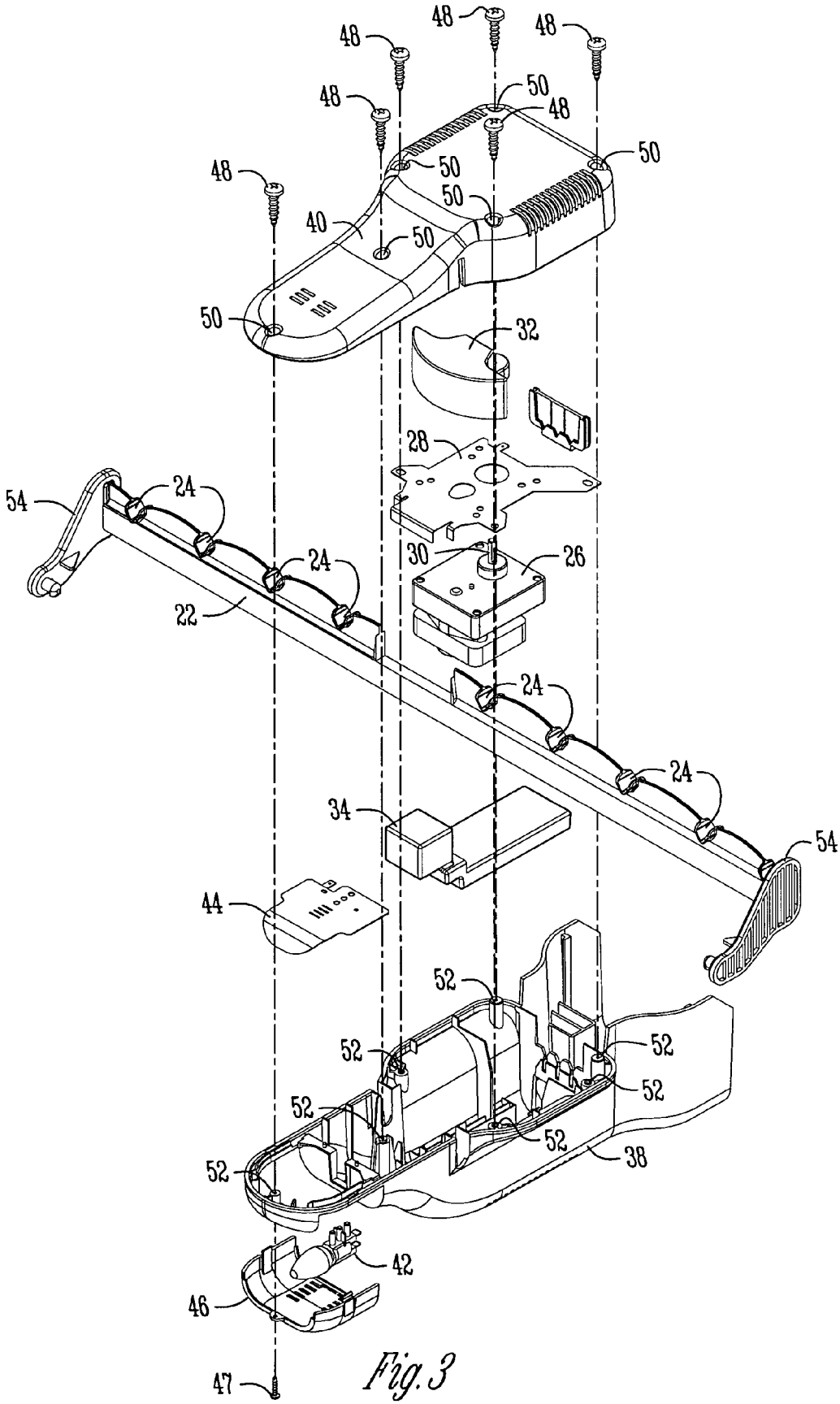
FIG. 3 is an exploded perspective view of the shaker assembly components.
Figure 4:
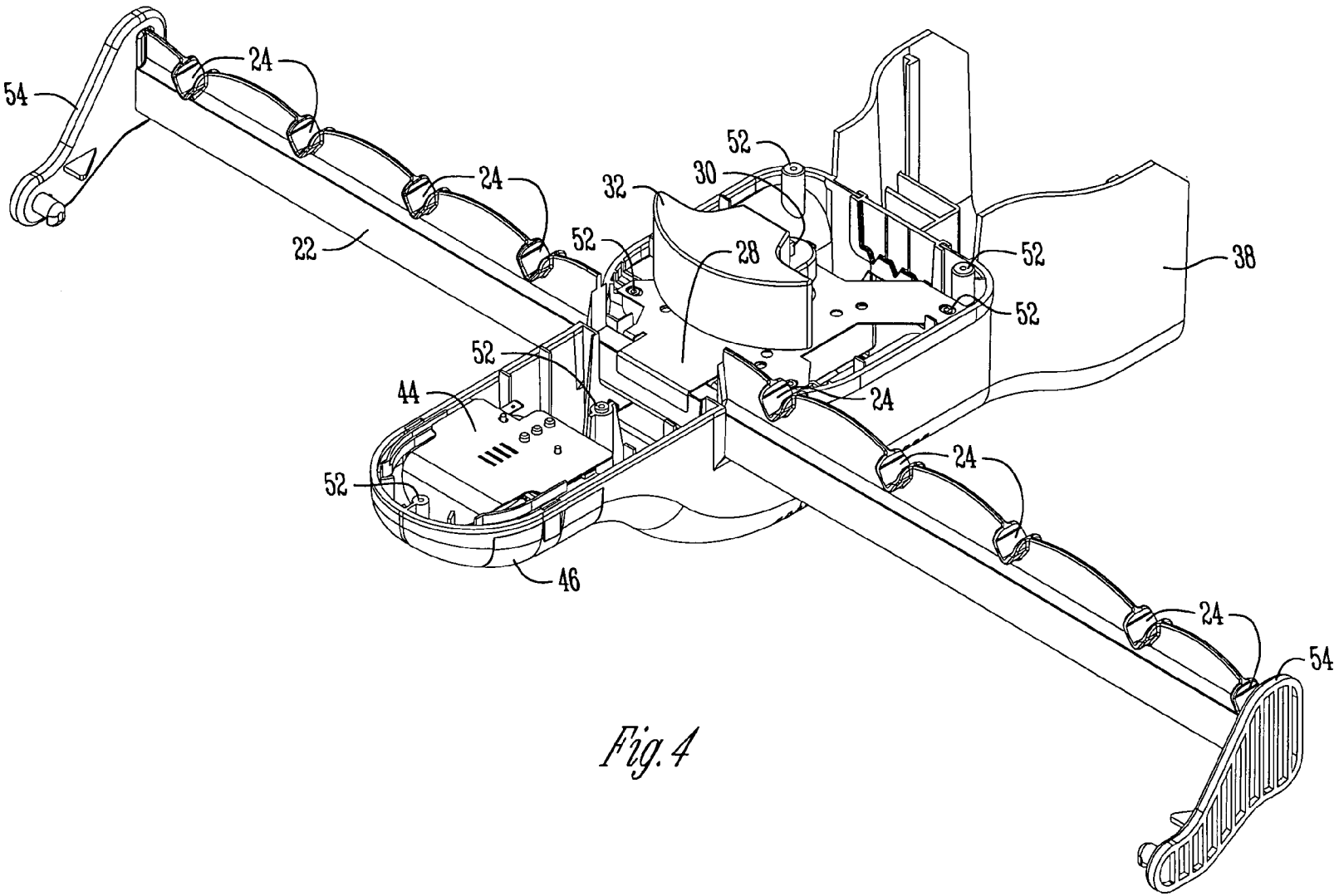
FIG. 4 is a view similar to FIG. 2 with the cover of the housing removed.
Figure 5:
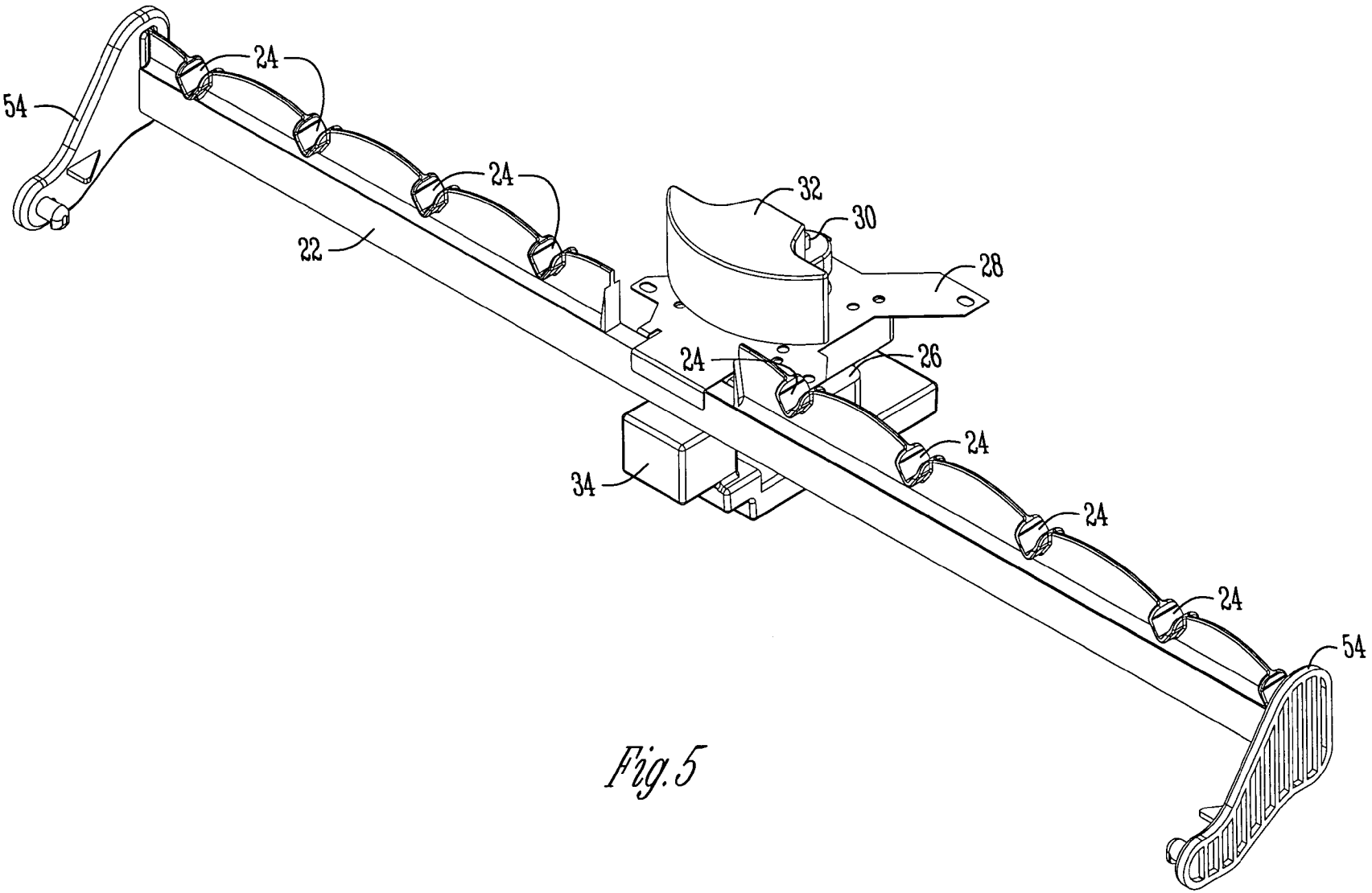
FIG. 5 is a view similar to FIG. 2 with the housing removed.

The details of the shaker assembly 14 are best seen in FIGS. 2 and 3. The shaker assembly 14 includes an elongated hanger bar 22 having a plurality of notches 24 adapted to receive conventional wire or plastic hangers (not shown).

The shaker assembly 14 also includes a drive motor 26 which is adjacent the bar 22. The motor 26 includes a drive shaft 30. A drive weight 32 is eccentrically mounted on the drive shaft 30. A ballast weight 34 is connected to the motor 26 using screws or any other convenient means.

The motor 26, drive weight 32, and ballast weight 34 are enclosed within a housing 36. The housing 36 includes a base 38 and a cover 40. The housing 36 may also include a light bulb 42 operatively mounted therein, with a reflector plate 44 and a lens 46. The light bulb 42 may be operatively wired so that the bulb automatically comes on when the doors 18 are opened and automatically shuts off when the doors 18 are closed. A screw 47 extends upwardly through the lens and into the base 38 so as to removably mount the lens for easy access to the light bulb 42 so as to permit quick and easy changing of the light bulb, when necessary.

The base 38 and cover 40 of the housing 36 are secured together by a plurality of screws 48 which extend through openings 50 in the cover 40 and into bosses 52 in the base 38. The motor mounting plate 28 has arms which extend to at least a pair of the bosses 52 with apertures through which the screws 48 extend so as to secure the mounting plate 28, the motor 26, the drive weight 32 and the ballast weight 34 within the housing 36.

The shaker assembly 14 is mounted in the drying chamber 12 using a three point suspension system. More particularly, each end of the bar 22 includes an arm 54. Each arm 54 is connected to a hanger or support 56. A similar support 58 is provided at the rear of the housing 36. The supports 56, 58 are mounted to the roof or ceiling of the drying chamber 12 in any convenient manner.

In use, one or more hangers with clothes are placed in the notches 24 on the bar 22 for drying. As heated air is forced into the chamber 12 for drying the clothes, the motor 26 is actuated. The drive weight 32 rotates about the drive shaft 30 so as to impart an oscillating or shaking action to the bar 22. The ballast weight 34 evenly distributes the energy from the drive weight 32 to the bar 22, regardless of the varying loads from hangers on the bar 22. For example, if a single hanger is placed on any one of the notches 24 of the bar 22, the ballast weight 34 will balance the oscillating motion of the bar 22 upon actuation of the motor 26. Similarly, if the bar 22 is fully loaded with clothes on hangers, the ballast weight 34 will balance the oscillating motion of the bar 22 upon actuation of the motor 26.

It has been discovered that the best frequency at which to remove wrinkles is 2 Hertz, which yields a swing period of 0.5 seconds for the bar 22. This is different than the natural frequency of 1.56 Hz achieved with the supports 56, 58 which are approximately 4.8 inches long, resulting in a period of 0.64 seconds. The driving frequency may range upwardly to approximately 2.42 Hz, resulting in a period of 0.41 seconds.

It is preferable to drive the shaker assembly at a frequency substantially away from the natural frequency. This reduces the potential for the system to oscillate in an uncontrolled manner, and also limits the shaker to desired deflection magnitudes. The driving frequency is preferably in the range of 20–80% higher than the natural frequency of the shaker assembly.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved shaker assembly for a clothes drying cabinet, comprising:

a bar adapted to be suspended in the cabinet for supporting clothes on hangers;

a motor adapted to be mounted adjacent the bar and having a drive shaft;

a first weight eccentrically mounted to the drive shaft of the motor; and whereby actuation of the motor rotates the first weight so as to impart an oscillating motion to the bar and a swaying motion to the clothes on hangers.

2. The improved shaker assembly of claim 1 further comprising a housing for enclosing the motor and first weight.

3. The improved shaker assembly of claim 2 further comprising a three point suspension system for the assembly.

4. The improved shaker assembly of claim 3 wherein the suspension system includes first and second supports adjacent opposite ends of the bar and a third support adjacent a rear portion of the housing.

5. The improved shaker assembly of claim 1 wherein the assembly is adapted to be supported in the cabinet at only three points.

6. The improved shaker assembly of claim 1 further comprising a second weight supported near the motor to equalize distribution of energy from the first weight to the bar with varying loads on the bar.

7. A method of shaking clothing in a drying cabinet to facilitate wrinkle removal, comprising:

hanging the clothing on a bar suspended in the cabinet; and shaking the bar using a rotating eccentrically mounted weight on a motor drive shaft; and thereby imparting swaying motion to the clothing to enhance wrinkle removal.

8. The method of claim 7 further comprising distributing energy from the rotating weight to the bar with a ballast weight.

9. The method of claim 7 wherein the shaking is at a frequency substantially greater than the natural frequency.

10. The method of claim 7 wherein the shaking is an oscillating motion along a longitudinal axis of the bar.

11. The method of claim 10 wherein the oscillating motion has a period of approximately 0.4 seconds.

12. A clothes drying cabinet, comprising:

a non-rotating chamber;

a bar suspended in the chamber for receiving hangers with clothes;

a motor mounted in the chamber and having a drive shaft;

a first weight eccentrically mounted on the drive shaft to shake the bar when the motor is actuated.

13. The clothes drying cabinet of claim 12 further comprising a housing surrounding the motor and first weight.

14. The clothes drying cabinet of claim 12 wherein the motor is connected to the bar.

15. The clothes drying cabinet of claim 14 further comprising a three point suspension system to support the motor and bar in the chamber.

16. The clothes drying cabinet of claim 12 further comprising a second weight adjacent the motor to control shaking of the bar.

17. The clothes drying cabinet of claim 12 further comprising a light to illuminate the chamber.

18. The clothes drying cabinet of claim 12 wherein the first weight is free from direct attachments to any wall of the chamber.

19. The clothes drying cabinet of claim 12 wherein the first weight shakes the bar at a frequency substantially greater than the natural frequency.

20. The improved shaker assembly of claim 1 wherein the weight is free from direct attachments to the cabinet.

21. The method of claim 7 further comprising connecting the weight to the cabinet solely through the drive shaft.

* * * * *